US006463236B2

(12) United States Patent
Morikami et al.

(10) Patent No.: US 6,463,236 B2
(45) Date of Patent: Oct. 8, 2002

(54) IMAGE FORMING APPARATUS

(75) Inventors: Yuusuke Morikami, Toyohashi; Takanobu Yamada; Seiichi Munemori, both of Toyokawa; Yasunori Nakayama, Gamagoori, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/874,290

(22) Filed: Jun. 6, 2001

(65) Prior Publication Data

US 2001/0051059 A1 Dec. 13, 2001

(30) Foreign Application Priority Data

Jun. 13, 2000 (JP) ..... 2000-176845

(51) Int. Cl.[7] ..... G03G 15/01; G03G 15/16; G03G 21/00

(52) U.S. Cl. ..... 399/121; 399/93; 399/98; 399/302

(58) Field of Search ..... 399/121, 125, 399/111, 110, 107, 299, 302, 92, 93, 98, 99; 347/138, 152

(56) References Cited

U.S. PATENT DOCUMENTS 5,028,959 A * 7/1991 Gooray ..... 399/93
5,303,018 A * 4/1994 Terada et al. ..... 399/299
5,612,767 A * 3/1997 Iwama ..... 399/98
5,612,771 A * 3/1997 Yamamoto et al. ..... 399/121
5,819,137 A * 10/1998 Hoffman et al. ..... 399/93
6,281,918 B1 * 8/2001 Burdick et al. ..... 347/138 X

FOREIGN PATENT DOCUMENTS

| | | |
|---|---|---|
| JP | 7-28294 | 1/1995 |
| JP | 09-127836 | * 5/1997 |
| JP | 2000-105493 | 4/2000 |
| JP | 2000-298421 | * 10/2000 |
| JP | 2000-315038 | * 11/2000 |

* cited by examiner

*Primary Examiner*—Sophia S. Chen
(74) *Attorney, Agent, or Firm*—Morrison & Foerster LLP

(57) ABSTRACT

An image forming apparatus comprising an intermediate transfer belt 12 having a horizontal belt part 12*a*, and a transfer section 34 arranged opposite the horizontal belt part 12*a* of the intermediate transfer belt 12 for transferring to a sheet overlaid images formed on the intermediate transfer belt 12 by a plurality of image forming sections 20Y, 20M, 20C, 20K for overlaying multiple images of respectively different color, wherein a belt unit 110 comprises a frame 112, at least three rollers 14, 16, 18 supported on frame 112, and the intermediate transfer belt 12 supported on the exterior surface of these rollers, and wherein the belt unit 110 can be installed and removed from the image forming apparatus body perpendicular to the shafts of the rollers 14, 16, 18, and parallel to the horizontal part 12*a*.

13 Claims, 7 Drawing Sheets

IMAGE FORMING APPARATUS

This application is based on application No. 2000-176845 filed in Japan, the content of which is hereby incorporated by reference.

BACKGROUND OF THE INVENTION

1. Field of the Invention

The present invention relates to a tandem-type color an image forming apparatus such as a printer and copying machine.

2. Description of the Related Art

So-called tandem type color image forming apparatuses are known which have a plurality of image forming units respectively accommodating toners of different colors arranged in parallel along an intermediate transfer belt, such as that disclosed, for example, in Japanese Laid-Open Patent Application NO. H7-28294.

In this type of image forming apparatus, images of respectively different color are superimposed one upon another on an intermediate transfer belt by the image forming units, and these overlaid images are transferred to a sheet used as a recording medium. Then, when the sheet passes through a fixing unit, the image on the sheet is heated and fixed to the sheet, and subsequently ejected to a discharge tray.

In an image forming apparatus wherein a plurality of image forming units are arranged along an intermediate transfer belt as previously described, each image forming unit and the intermediate transfer belt are removable from the apparatus in the direction of the rotational axis for jam handling and maintenance. However, when removing each image forming unit and the intermediate transfer belt in the rotational axis direction, a large opening must be provided, for example, in the frame on the front side of the apparatus body. For this reason a disadvantage arises inasmuch as the rigidity of the frame of the apparatus body is reduced. Furthermore, the rotational axis of the image forming units and the intermediate transfer belt are supported only by the frame on the interior side. For this reason it is difficult to support the rotating shafts of a plurality of image forming units in parallel, such that the images formed by the image forming units become skewed so as to disrupt the image.

SUMMARY OF THE INVENTION

In view of these disadvantages, an object of the present invention is to provide an image forming apparatus capable supporting the rotating shafts of image forming units in parallel without reducing the rigidity of the frame of the apparatus body, so as to form images which are not disrupted.

These objects are attained by the image forming apparatus of the present invention comprises: a belt unit having a frame, and at least three rollers supported by the frame, and an intermediate transfer belt supported on the exterior surface of the three rollers, and wherein the intermediate transfer belt includes a horizontal belt section; a plurality of image forming units arranged opposite the horizontal belt section of the intermediate transfer belt for overlaying images of different colors to form an overlay image; and a transfer device for transferring the overlay image formed on the intermediate transfer belt onto a sheet; wherein the belt unit is supported so as to be removable from the image forming apparatus in a direction perpendicular to the roller shafts and parallel to horizontal belt section.

According to this construction, since the belt unit is removable from the image forming apparatus in a direction perpendicular to the roller shafts and parallel to the horizontal belt section, the opening formed in the frame of the apparatus is smaller than an opening to allow removal parallel to the roller shafts, and rigidity of the frame is not reduced. For this reason the rotating shafts of the image forming units can be supported in parallel each other so as to produce disrupted images.

According to another aspect of the present invention, the image forming apparatus comprises a belt unit having a frame, and at least three rollers supported by the frame, and an intermediate transfer belt supported on the exterior surface of the three rollers, and wherein the intermediate transfer belt includes a horizontal belt section; a plurality of image forming units arranged opposite the horizontal belt section of the intermediate transfer belt for overlaying images of different colors to form an overlay image; a transfer device for transferring the overlay image formed on the intermediate transfer belt onto a sheet; and a body frame for containing the belt unit and the image forming units and having a first vertical frame in which an opening is formed to remove the belt unit in first direction and a second vertical frame in which an opening is formed to remove the image forming units in second direction.

BRIEF DESCRIPTION OF THE DRAWINGS

These and other objects and features of this invention will become clear from the following description, taken in conjunction with the preferred embodiments with reference to the accompanied drawings in which:

FIG. 4A shows the guide panel, FIG. 4B shows condition directly before installation or directly after removal of the belt unit, and FIG. 4C shows the belt unit installed;

DETAILED DESCRIPTION OF THE PREFERRED EMBODIMENTS

Figure 1:
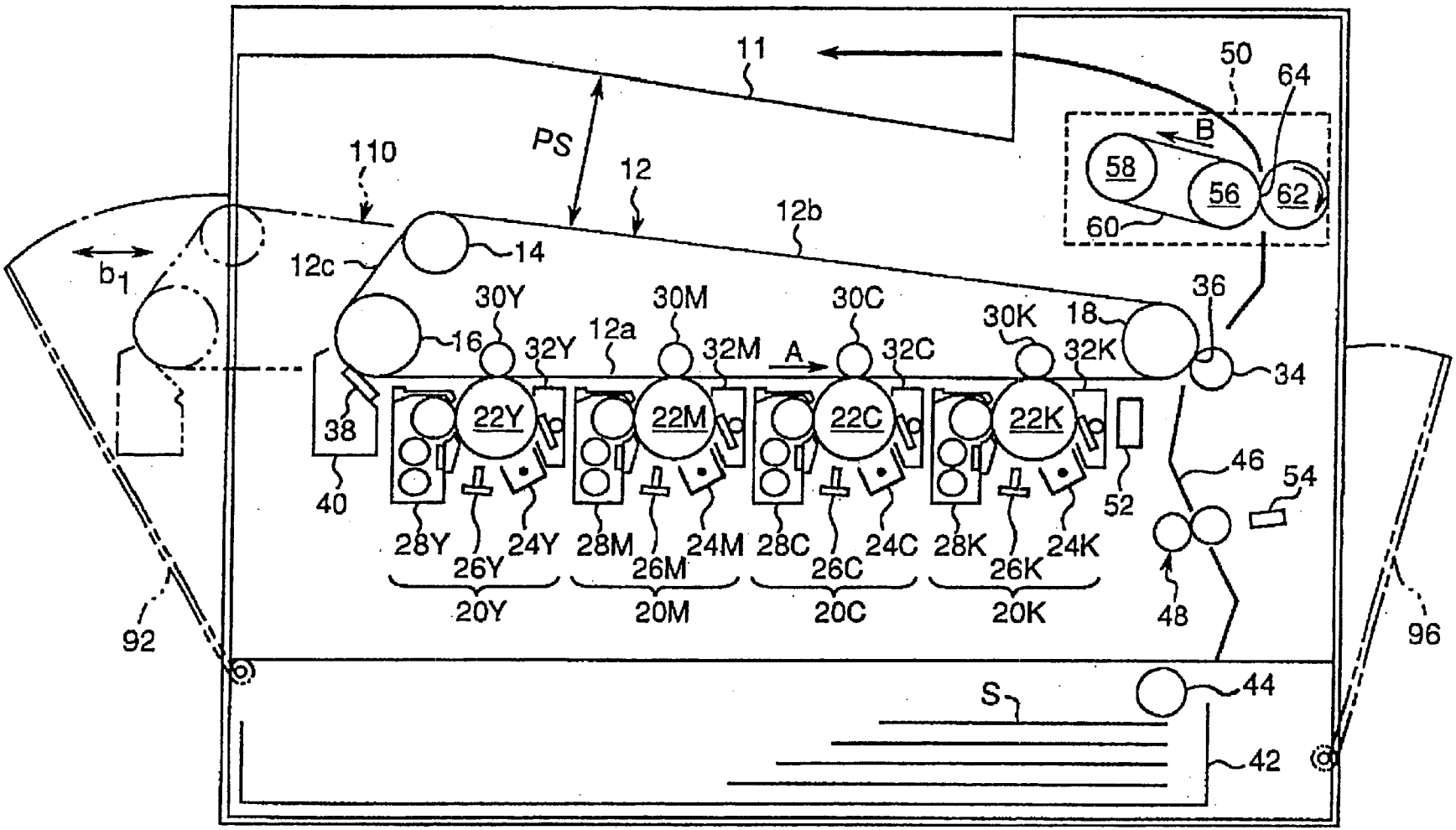
FIG. 1 briefly shows the structure of a printer of an embodiment according to the present invention.

The preferred embodiments of the present invention are described hereinafter with reference to the accompanying drawings. FIG. 1 shows the general construction of a tandem-type digital color printer (hereinafter referred to simply as "printer") of an embodiment of the present invention.

First, the construction and operation of the printer are briefly described. The printer 10 is provided with an intermediate transfer belt 12 near the center of the interior. The intermediate transfer belt 12 is supported by the exterior surfaces of three rollers 14, 16, and 18 so as to be rotates in the arrow A direction.

Below the bottom horizontal part of the intermediate transfer belt 12 are arranged four image forming units 20Y, 20M, 20C, 20K respectively accommodating toner in the colors of yellow (Y), magenta (M), cyan (C), and black (K) and disposed along the intermediate transfer belt 12.

The image forming units 20Y, 20M, 20C, 20K respectively accommodate a photosensitive drum 22Y, 22M, 22C, 22K. Disposed sequentially in the direction of rotation around the periphery of each photosensitive drum 22Y, 22M, 22C, 22K in the direction are, respectively, charger, 24Y, 24M, 24C, 24K, print head 26Y, 26M, 26C, 26K, developing device 28Y, 28M, 28C, 28K, primary transfer rollers 30Y, 30M, 30C, 30K disposed opposite the photosensitive drums 22Y, 22M, 22C, 22K and gripping the intermediate transfer belt therebetween, and cleaners 32Y, 32M, 32C, 32K. The print heads 26Y, 26M, 26C, 26K comprises a plurality of LEDs aligned in a main scan direction parallel to the axial direction of the photosensitive drums.

A secondary roller 34 makes pressure contact with the part of the intermediate transfer belt 12 supported by a roller 18. A nip between the secondary roller 34 and the intermediate transfer belt 12 forms a secondary transfer region 36.

A belt cleaner 38 makes pressure contact with the intermediate transfer belt 12 at the part supported by a roller 16. The belt cleaner 38 sweeps residual toner on the intermediate transfer belt 12 after the secondary transfer and collects this toner in a toner collection box 40.

A removable paper cassette 42 is disposed at the bottom of the printer 10. Sheets S accommodated within the paper cassette 42 are fed one sheet at a time from the uppermost sheet to a transport path 46 by the rotation of a take-up roller 44.

The transport path 46 extends from the paper cassette 42 through the nip formed by a pair of timing rollers 48, secondary transfer region 36, and fixing unit 50, to the discharge tray 11.

An automatic image density control (AIDC) sensor 52 (i.e., image density sensor), also serving as a resistance sensor, is provided between the secondary transfer region 36 and the image forming unit 20K on the farthest downstream side of the intermediate transfer belt 12. A timing sensor 54 is provided near the pair of timing rollers 48 for detecting whether or not a sheet S has arrived at the set of timing rollers 48.

The fixing unit 50 is provided with a fixing belt 60 supported by a pair of rollers 56 and 58 and rotates in the arrow B direction, and a fixing roller 62 which makes pressure contact with the roller 56 through the fixing belt 60 and is driven in rotation in the arrow direction. A sheet bearing a transferred toner image passes through a fixing region 64 comprising the nip formed between the fixing belt 60 and the fixing roller 62.

The operation of the printer 10 having the above-mentioned construction is briefly described below.

When an image signals is input to an image signal processor (not illustrated) from an external device (e.g., a personal computer), a digital image signal which color converts this image signal to yellow, magenta, cyan, or black is generated by the image signal processor, and this digital image signal is transmitted to the LED drive circuit of the print head. The drive circuit executes the emission of the print heads 26Y, 26M, 26C, 26K of the image forming units 20Y, 20M, 20C, 20K to effect exposure based on the input digital signal. This exposure is performed based on the sequential time difference of the print heads 26Y, 26M, 26C, 26K. In this way an electrostatic latent image is formed on the surface of the photosensitive drums 22Y, 22M, 22C, 22K.

The electrostatic latent images formed on the photosensitive drums 22Y, 22M, 22C, 22K are respectively developed by the developing devices 28Y, 28M, 28C, 28K to form toner images in each color. Then, the toner image of each color is sequentially overlaid on the intermediate transfer belt 12 moving in the arrow A direction in a primary transfer via the action of the primary transfer rollers 30Y, 30M, 30C, 30K.

The overlaid toner images formed on the intermediate transfer belt 12 arrive at the secondary transfer region 36 in conjunction with the movement of the intermediate transfer belt 12. In the secondary transfer region 36, the overlaid toner images are batch transferred in a secondary transfer onto a sheet S transported from the cassette 42 to the transport path 46 and fed from a pair of timing rollers 48. After the secondary transfer, the residual toner on the intermediate transfer belt 12 is collected by the belt cleaner 38.

The sheet S bearing the secondary transfer toner image is transported through the transport path 46 to the fixing unit 50, and the toner image is fixed to the sheet S as it passes through the fixing region 64. Then, the sheet S is ejected to the discharge tray 11.

The specific structure of each part of the printer 10 is described below.

Figure 2:
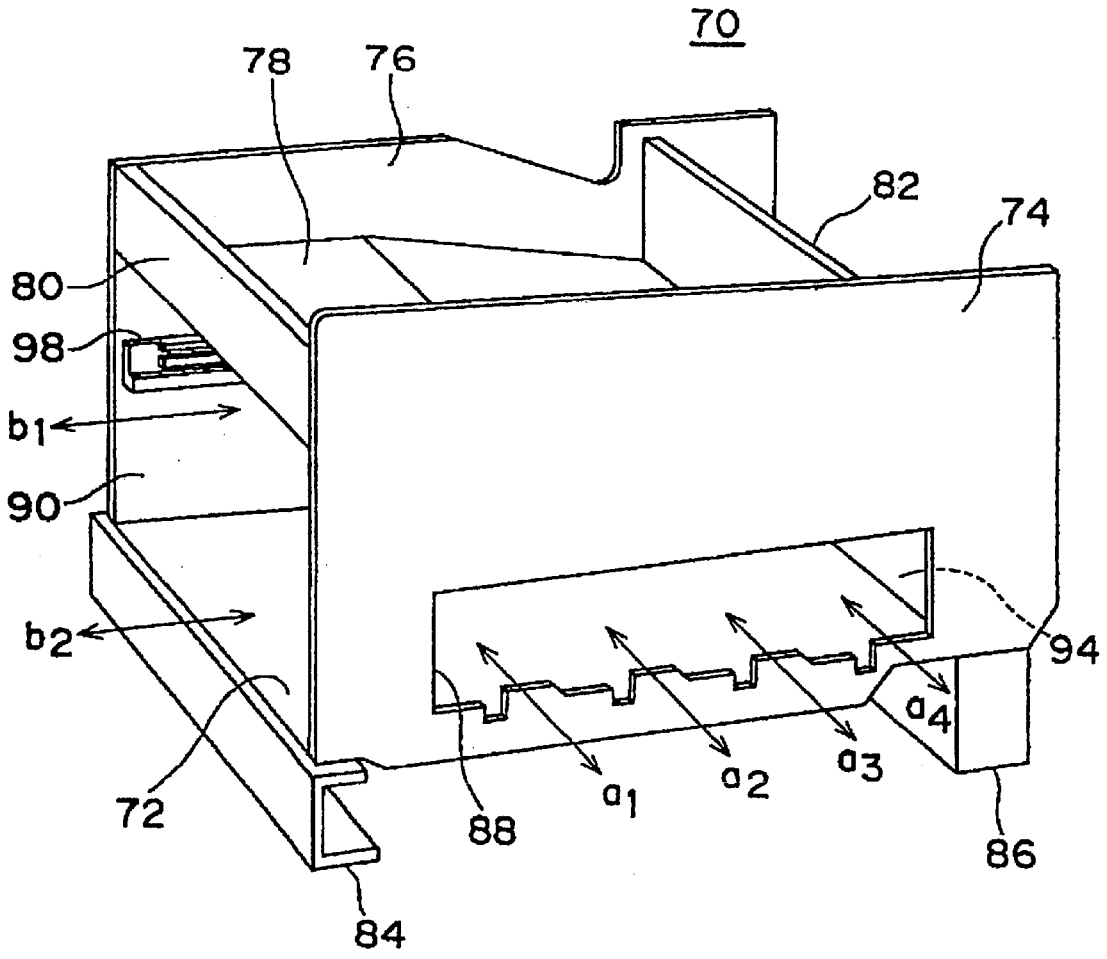
FIG. 2 is a perspective view of the body frame of the printer of FIG. 1.

The printer 10 has a body frame 70 shown in FIG. 2, and the body frame 70 comprises a base frame 72, front frame 74, back frame 76, top frame 78, left connector frame 80, and right connector frame 82. Undercarriages 84 and 86 are provided on the bilateral ends of the base frame 72, and a space for loading the paper cassette 42 is formed between these undercarriages 84 and 86. An opening 88 is provided in the front frame 74 for loading/removing the photosensitive member units 130Y, 130M, 130C, 130K (described later) of the four image forming units 20 in the directions of arrow a1, a2, a3, a4. A door not shown in the drawing is mounted on the front frame 74. The top frame 78 forms the sheet discharge tray 11, and the approximate center part is inclined so as to elevate a sheet S toward the discharge direction in the discharge tray 11.

An opening 90 formed on the left side of the body frame 70 is provided for loading/removing the belt unit 110 (described later) of the intermediate transfer belt 12 in a direction b1 perpendicular to the loading/removing direction of the photosensitive member units 130Y, 130M, 130C, 130K, and is further provided for loading/removing an optical system unit 180 (described later) in a direction b2 parallel to the direction b1. This left side opening 90 is opened and closed by using a left door 92, as shown in FIG. 1. Similarly, a right side opening 94 is formed in the body frame 70 and is opened using a right door 96.

Figure 3:
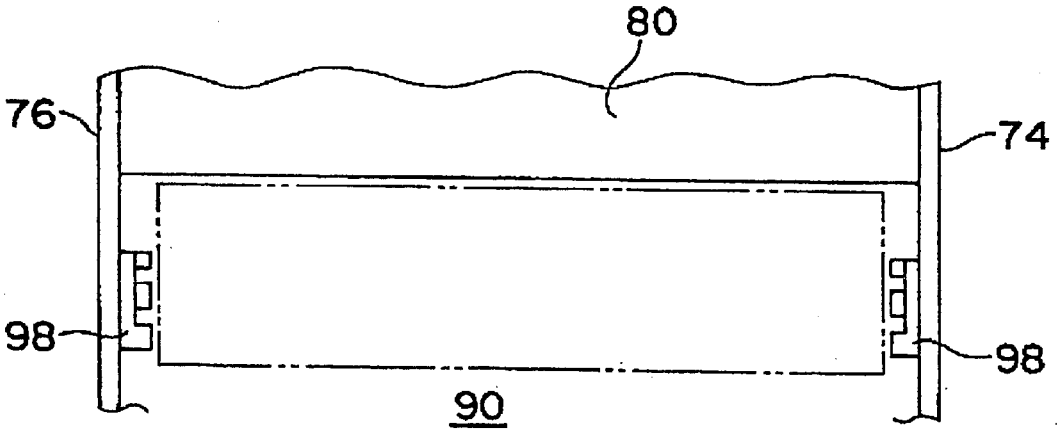
FIG. 3 is a partial side view of the body frame of FIG. 2.
Figure 4A:
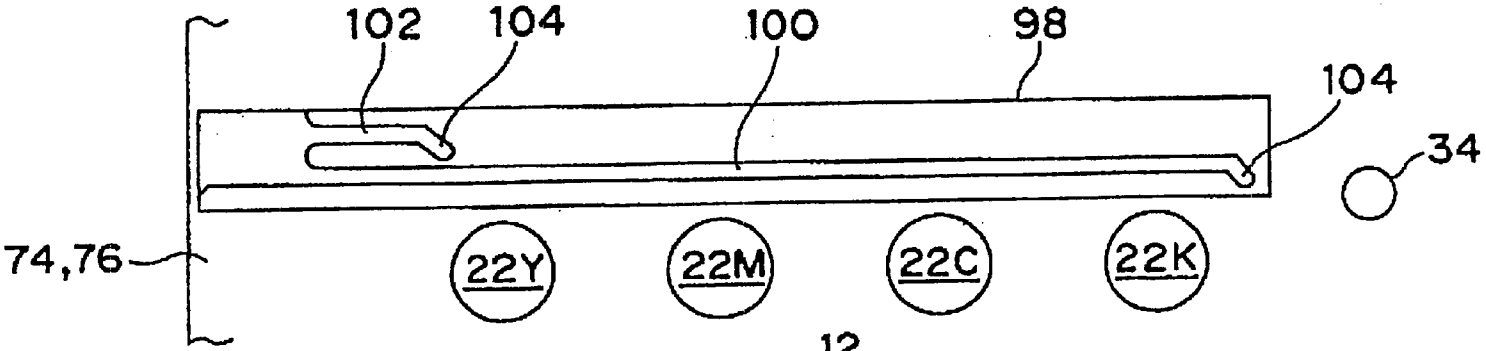
FIGS. 4A to 4C are partial front interior views before and behind the body of FIG. 2.
Figure 4B:
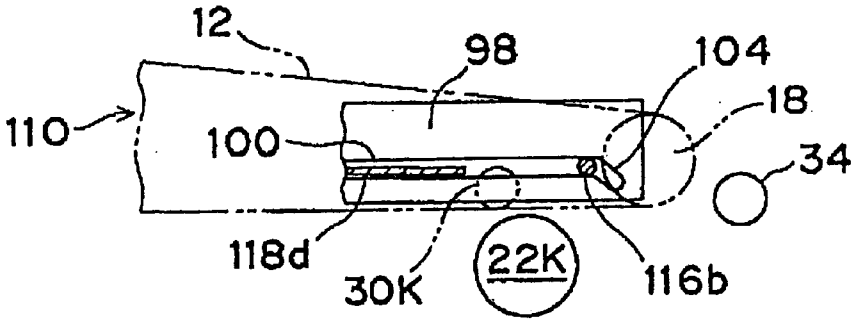
Figure 4C:
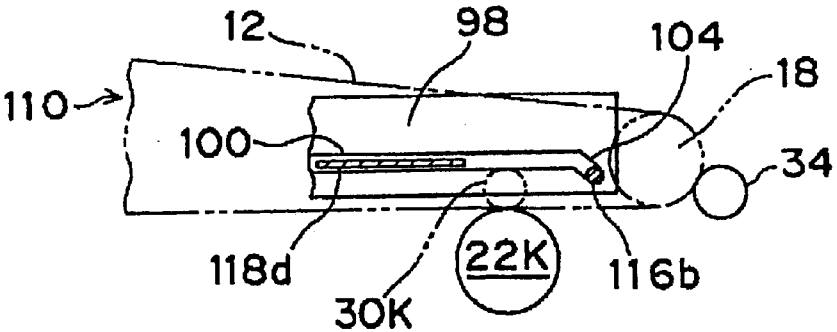

A guide panel 98 for supporting the intermediate transfer belt 12 is mounted on the interior surface of the front frame 74 and the interior surface of the back frame 76, as shown in FIG. 3. Formed on the guide panel 98 are a first guide channel 100 extending horizontally from the left end, and a second guide channel 102 shorter than the first guide channel above the first guide channel, as shown in FIGS. 4A to 4C. The inner end of the first guide channel 100 and the second guide channel 102 end at a sloping end 104 having a downward inclination.

Figure 5:
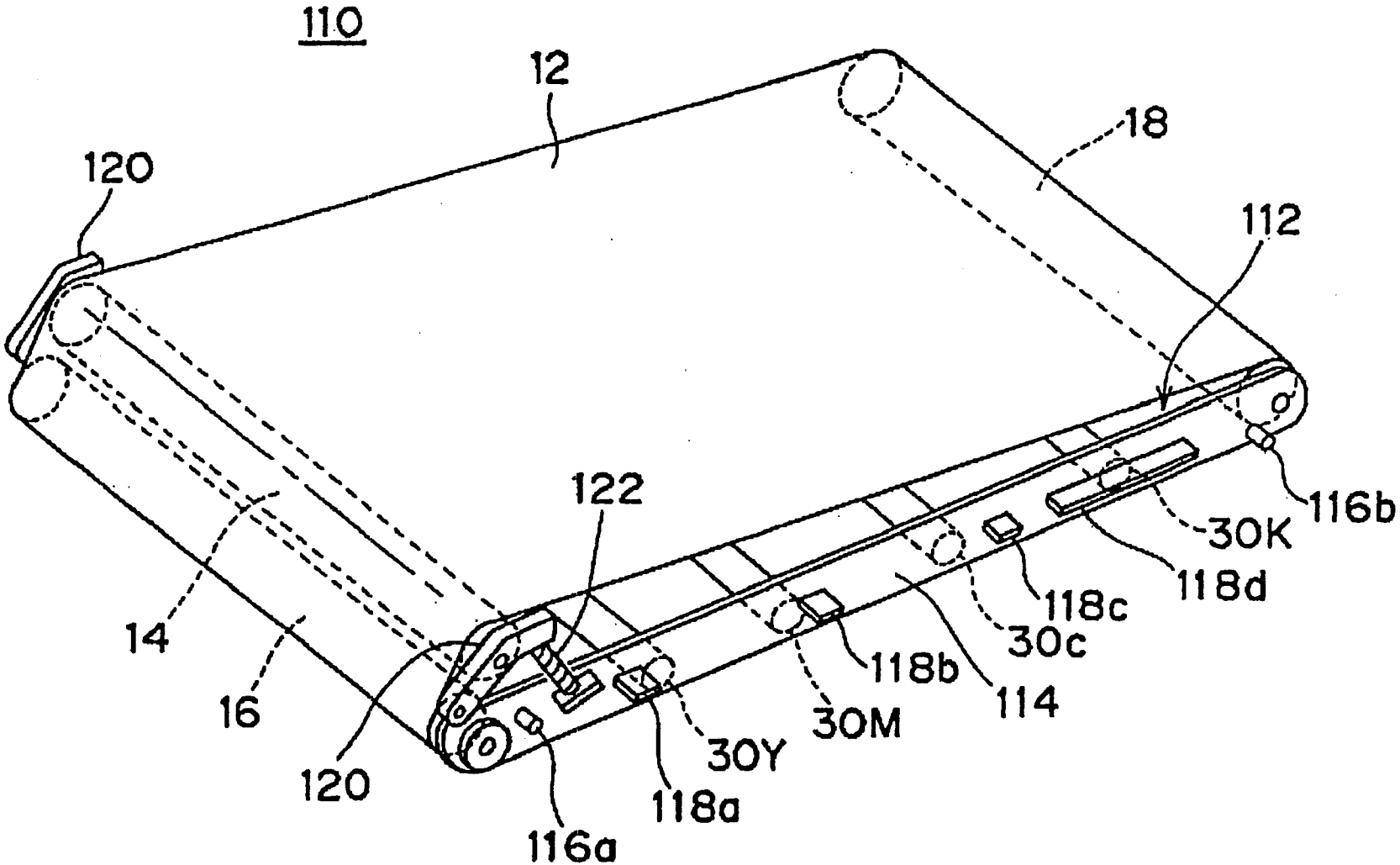
FIG. 5 is a perspective view of the belt unit.

The intermediate transfer belt 12 is constructed of a belt unit 110 as shown in FIG. 5, so as to be removable from the body frame 70 in the b1 direction. That is, the belt unit 110 comprises a frame 112, three rollers 14, 16, 18 supported on the frame 112, intermediate transport belt 12 supported on the exterior surface of the rollers 14, 16, 18, and the four primary transfer rollers 30Y, 30M, 30C, 30K.

The frame 112 comprises a pair of horizontal side panels (only front side shown in the drawing) 114, and connectors (not illustrated) for connecting these side panels. Projections 116*a* and 116*b* respectively protrude from the side panel 114 near roller 16 and roller 18, and a plurality of flanges 118*a*, 118*b*, 118*c*, 118*d* project between the roller 16 and roller 18. Projection 116*a* is positioned above a line connecting the roller 16 and roller 18, whereas projections 116*b* and flanges 118*a*, 118*b*, 118*c*, 118*d* are positioned on a line connecting roller 16 and roller 18.

The two rollers 16 and 18 among the three rollers 14, 16, 18 are supported at bilateral ends of side panel 114 of the frame 12, and the remaining roller 14 is supported on an arm 120 mounted so as to be rotatable on side panel 114 near roller 16, such that the intermediate transfer belt 12 is lifted by a spring 122 installed between the tip of the arm 120 and the side panel. In this way the intermediate transfer belt 12 supported on the three rollers 14, 16, 18 comprises a horizontal belt part 12*a* between roller 16 and roller 18, a long first inclined belt part 12*b* between roller 18 and roller 14, and a short second inclined belt part 12*c* between roller 16 and roller 14. The first inclined belt part 12*b* is nearly parallel to the discharge tray 11.

The primary transfer rollers 30Y, 30M, 30C, 30K are disposed at the same pitch as the image forming units 20Y, 20M, 20C, 20K and bilateral ends are supported so as to be rotatable on the side panels 114 so as to make contact with the interior surface of the horizontal belt part 12*a* of the intermediate belt 12 between the roller 16 and the roller 18.

The image forming units 20Y, 20M, 20C, 20K are separated into three units which are removable from the body frame 70. That is, the primary transfer rollers 30Y, 30M, 30C, 30K of the image forming units 20Y, 20M, 20C, 20K are incorporated in a single belt unit 110. The photosensitive member units 22Y, 22M, 22C, 22K, and chargers 24Y, 24M, 24C, 24K, and developing devices 28Y, 28M, 28C, 28K, and cleaners 32Y, 32M, 32C, 32K of each image forming unit 20Y, 20M, 20C, 20K respectively comprise the photosensitive member units 130Y, 130M, 130C, 130K. The print heads 26Y, 26M, 26C, 26K of the image forming units 20Y, 20M, 20C, 20K comprise a single optical system unit 180.

The photosensitive member units 130Y, 130M, 130C, 130K are approximately square in shape viewed from the axial direction of the photosensitive drums 22Y, 22M, 22C, 22K, and specifically are supported between a front frame 132 and back frame 134 having an inverted U-shape. Since the photosensitive member units 130Y, 130M, 130C, 130K are approximately square in shape, they have excellent spatial efficiency in vertical and lateral directions of the apparatus, such that the apparatus has a more compact form factor.

Guide channels 136 are formed on the bilateral endfaces of the front frame 132 and back frame 134 so as to engage a reverse L-shaped rail 192 mounted on the optical system unit 180 described later, and a brush 138 is mounted on the base of both undercarriages of the back frame 134 so as to contact the LED array 190 of the optical system unit 180 described later. Furthermore, a bracket 140 protrudes from the side surface of the black (K) photosensitive member unit 130K, and a brush 142 is mounted facing downward on this bracket 140.

Figure 9:
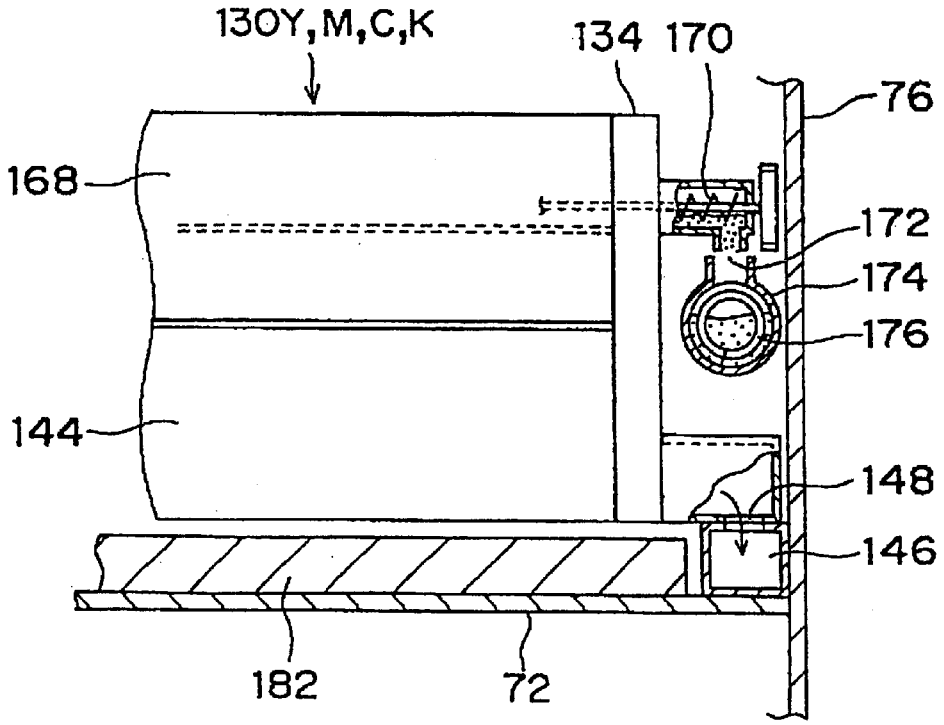
FIG. 9 is a section view of the interior side showing the photosensitive member unit installed.
Figure 10:
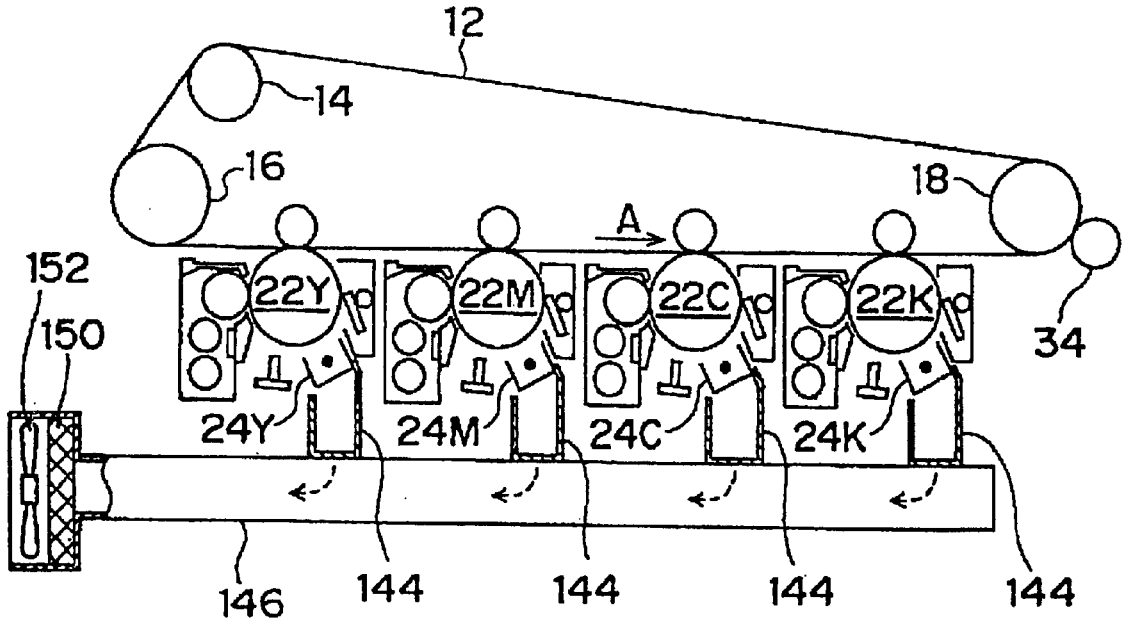
FIG. 10 briefly shows the ozone collection mechanism.

Below the chargers 24Y, 24M, 24C, 24K are disposed approximately U-shaped troughs 144 along the chargers 24Y, 24M, 24C, 24K to receive ozone generated by the chargers 24Y, 24M, 24C, 24K. The inner side of the trough 144 projects from the back frame 134 as shown in FIG. 9, and the bottom of the trough 144 contacts a duct 146 extending in a direction perpendicular to the shaft of the photosensitive drums 22Y, 22M, 22C, 22K, and this bottom is provided with openings 148 which communicate with the duct 146. The duct 146 is fixedly attached to the back frame 76. As shown in FIG. 10, one end of the duct 146 is closed, and the other end is open and has an ozone filter 150 and fan 152 mounted therein. According to this construction, when the fan 152 is actuated, the ozone generated by the chargers 24Y, 24M, 24C, 24K is suctioned downward through the trough 144, passes through the opening 148 and through the duct 146, and is collected by the ozone filter 150. By suctioning the ozone which has a large specific gravity in this way, the space of the apparatus is effectively used, ozone suctioning efficiency is increased, and such suctioning can be accomplished using a small capacity fan 152.

Figure 6:
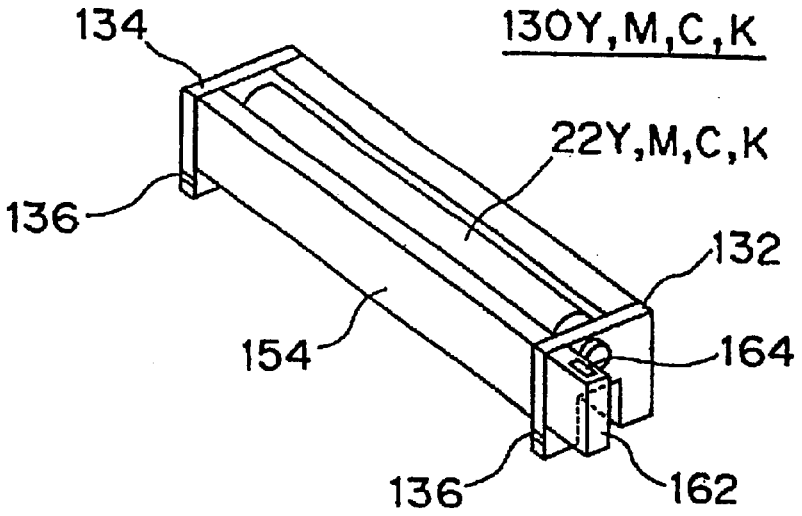
FIG. 6 is a perspective view of the photosensitive member unit.
Figure 7:
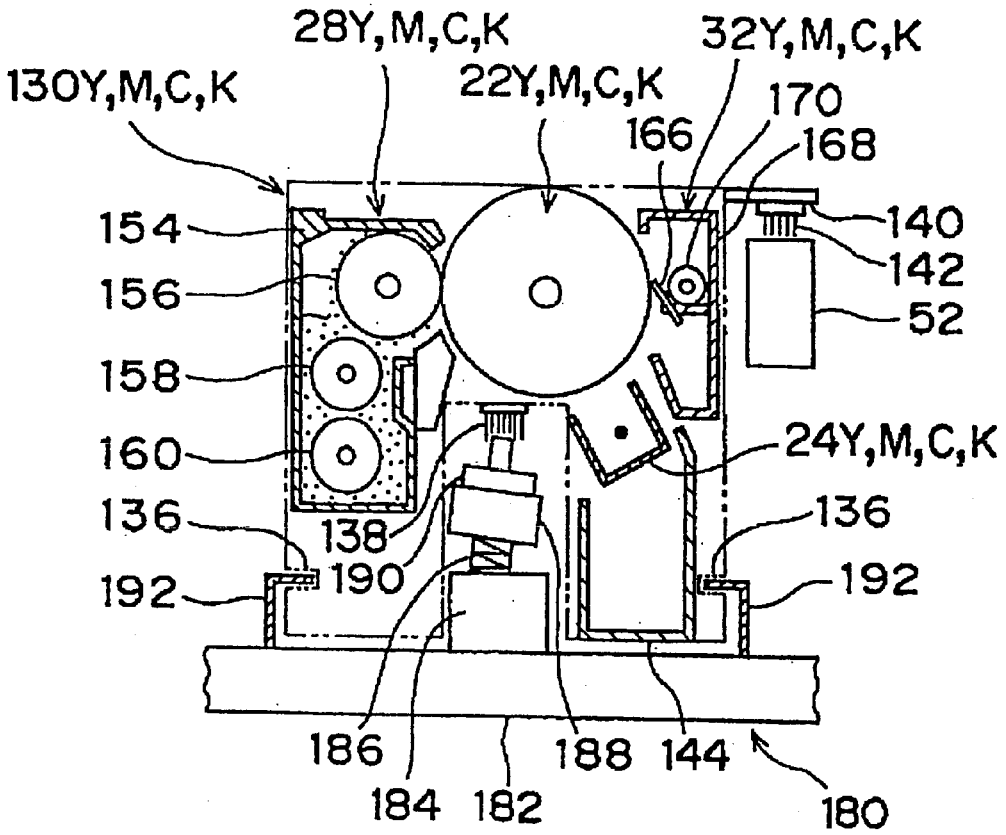
FIG. 7 is an enlarged section view of the photosensitive member unit.

The developing devices 28Y, 28M, 28C, 28K comprise a developer tank 154 accommodating toner of specific color, developing roller 156 disposed so as to expose part of the exterior surface to an opening of the developing tank 154, two transport rollers 158 and 160 for mixing and transporting the toner within the developer tank 154 to the developing roller 156, and wherein the developing roller 156 is disposed near the photosensitive drum 22Y, 22M, 22C, 22K, as shown in FIG. 7. One end of the developer tank 154 extends from the front frame 132 as shown in FIG. 6, and a supply opening 164 is formed in the top of the protrusion 162 to supply toner. In this way, when the photosensitive member units 130Y, 130M, 130C, 130K are installed, toner is supplied from the supply opening 164 through a hopper (not illustrated) provided on the front frame 74 of the body frame 70.

The cleaners 32Y, 32M, 32C, 32K comprise a blade 166 pressed against the photosensitive drums 22Y, 22M, 22C, 22K for removing residual toner remaining on the photosensitive drum surface, a cleaner vessel 168 for receiving the toner removed by the blade 166, and a transport screw 170 for transporting the toner to the interior side. The cleaner vessel 168 protrudes from the back frame 134, as shown in FIG. 9. The toner transported to the interior side by the transport screw 170 falls through the opening 172, and is transported by a transport coil 176 within a waste toner transport pipe 174, to be collected in a waste toner hopper not shown in the drawing.

Figure 11:
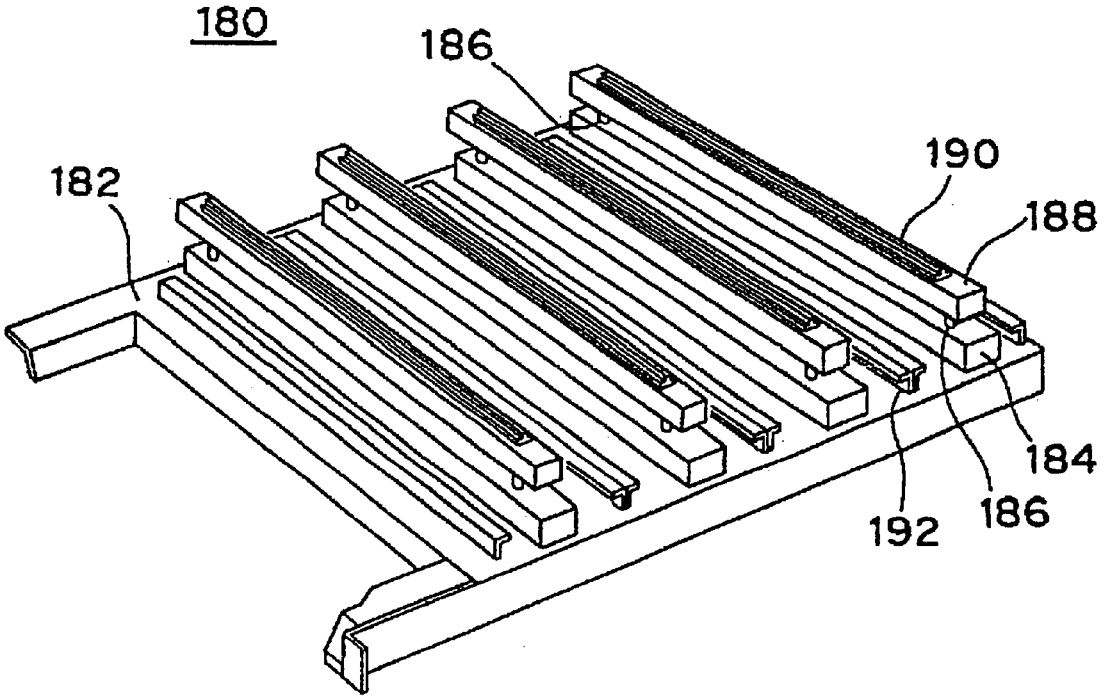
FIG. 11 is a perspective view of the optical system unit.

The optical system unit is arranged at a pitch identical to the alignment pitch of the image forming units 20Y, 20M, 20C, 20K above the base plate 182, as shown in FIG. 11, and comprises four mounting bases 184 extending in the axial direction of the photosensitive drums 22Y, 22M, 22C, 22K, LED base 188 supported through two springs 186 on top of the mounting base 184, and LED array 190 mounted on the LED base 188. A reverse L-shaped rail 192 is mounted on the optical system unit 180 to guide the photosensitive member unit 130Y, 130M, 130C, 130K between each mounting base 184.

Described below are the operations of installing and removing the belt unit 110, photosensitive member unit 130Y, 130M, 130C, 130K, and optical system unit 180 into and from the printer 10 having the aforesaid structure.

Removing the belt unit 110 is accomplished by opening the left door 92 of the body frame 70 shown in FIG. 1, and pulling it out together with the belt cleaner 38 in a horizontal direction b1 from the left side, i.e., opposite side from the secondary transfer roller 34. At this time, as shown in FIGS. 4C to 4B, since the projections 116*a* and 116*b* of the belt unit 110 move along the inclined end 104 of the first and second guide channels 100 and 102, the belt unit 110 separates from the photosensitive drums 22Y, 22M, 22C, 22K and the intermediate transfer belt 12 simultaneously in an inclined upward direction. Therefore, the intermediate transfer belt is not rubbed by the photosensitive drums 22Y, 22M, 22C, 22K or the secondary transfer roller 34, and damage is prevented to the photosensitive drums 22Y, 22M, 22C, 22K and the secondary transfer roller 34. Then, the projections 116*a* and 116*b* of the belt unit 110 move along the first and second guide channels 100 and 102, and the belt unit 110 is not inclined and is pulled out while maintaining a horizontal orientation because the flanges 118*a*~118*d* engage the first guide channel 100 even when the projection 116*a* separates from the second guide channel 102. Installation of the belt unit 110 is accomplished by the reverse operation to the removal. While the projections 116*a* and 116*b* of the belt unit 110 move through the first and second guide channels 100 and 102, the intermediate transfer belt 12 does not touch the photosensitive drums 22Y, 22M, 22C, 22K, and the projections 116*a* and 116*b* start to move through the sloping end 104 of the first and second guide channels 100 and 102, the intermediate transfer belt 12 contacts the photosensitive drum 22Y, 22M, 22C, 22K and contacts the secondary transfer roller 34, as shown in FIGS. 4B~4C. For this reason, even during installation damage is prevented to the photosensitive drums 22Y, 22M, 22C, 22K.

Since the belt unit 110 is removed by pulling it out from the left side, the secondary transfer roller 34 and the sheet transport path 46 on the right side do not present an obstacle, and the photosensitive member unit 130 on the bottom side does not present an obstacle such that space is used efficiently. Furthermore, since the belt unit 110 can be removed together with the belt cleaner 38, there is neither toner spillage nor soiling of the surrounding compared to when each is removed separately. In addition, compared to when the belt unit 110 is pulled out from the front, the opening formed in the body frame of the apparatus has a smaller area, and the strength of the body frame 70 is not reduced so as to be insufficient.

Since the first inclined belt 12*b* of the belt unit 110 is parallel to the discharge tray 11, as shown in FIG. 1, a parallel space PS is maintained between the first inclined belt 12*b* and the discharge tray 11. This space PS is enlarged as the belt unit 110 is pulled out, such that even when various other components are provided in this space PS, these components do not obstruct the removal of the belt unit 110 and the space PS is effectively used, and conversely the apparatus can be made more compact since the space PS can be reduced.

Since the belt unit 110 is removed from the opposite side from the secondary transfer roller 34, a retraction mechanism or the like for the secondary transfer roller 34 is unnecessary, and the construction is simplified.

Figure 8:
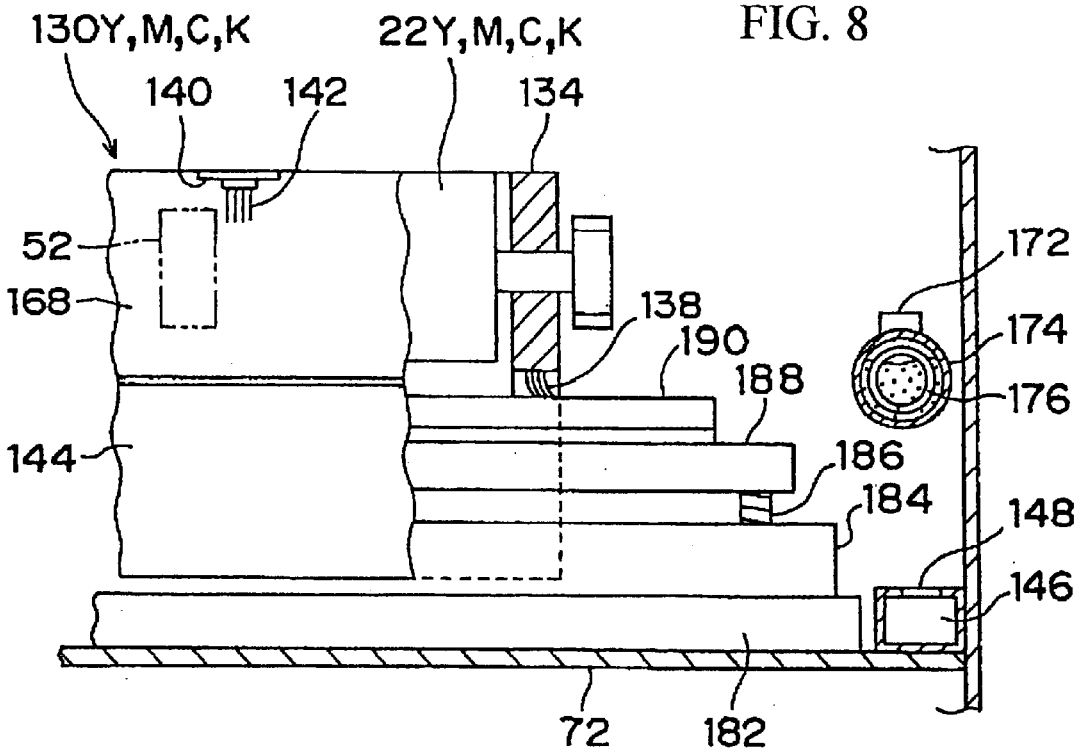
FIG. 8 is a section view of the interior side showing the photosensitive member unit withdrawn.

The installation and removal of the photosensitive member units 130Y, 130M, 130C, 130K can be accomplished by opening a door (not illustrated) on the front of the body frame 70, and pulling out a desired photosensitive member units 130Y, 130M, 130C, 130K to the front side, or inserting the photosensitive member units 130Y, 130M, 130C, 130K to the inner side. At this time, photosensitive member units 130Y, 130M, 130C, 130K move smoothly as the guide channel 136 provided on the front and back frames 132 and 134 of the photosensitive member units 130Y, 130M, 130C, 130K are guided on the rail 192. When installing/removing the photosensitive member units 130Y, 130M, 130C, 130K, the brush 138 provided on the back frame 134 sweeps the light-emitting surface of the LED array 190, and the brush 142 provided on the side of the photosensitive member units 130Y, 130M, 130C, 130K sweeps the top surface of the AIDC sensor 52, as shown in FIG. 8. In this way cleaning of the optical system unit on the inaccessible interior side is accomplished automatically each time the photosensitive member unit is installed or removed, such that manual cleaning of the optical system unit by inserting the hand in narrow spaces and using special tools is unnecessary, and cleaning is accomplished in a simple automatic operation.

Installation and removal of the optical system unit 180 is accomplished in the b2 direction parallel to the b1 direction for installing/removing the belt unit 110, i.e., by pulling out the optical system unit 180 in a horizontal direction from the left side of the body frame 70. At this time, it is unnecessary to remove beforehand all the photosensitive member units 130Y, 130M, 130C, 130K, and there is no impediment since the replacement and repair of the optical system unit 180 does not occur frequently compared to the photosensitive member units 130Y, 130M, 130C, 130K.

As clear from the preceding description, according to the structure of the above embodiments the belt unit is installed and removed from the image forming apparatus body perpendicular to the roller shafts, and parallel to the horizontal belt section, such that the opening formed in the frame of the apparatus body is smaller than when the belt unit is installed/removed parallel to the roller shaft, and rigidity of the frame is not reduced. Therefore, the rotating shafts of the image forming units are supported in parallel, and images are effectively formed without disturbance.

Obviously, many modifications and variation of the present invention are possible in light of the above teachings. It is therefore to be understood that within the scope of the appended claims, the invention may be practiced other than as specifically described.

What is claimed is:

1. An image forming apparatus comprising:

a belt unit having a frame, at least three rollers supported by the frame, and an intermediate transfer belt supported on exterior surfaces of the three rollers, wherein the intermediate transfer belt includes a horizontal belt section;

a plurality of image forming units arranged opposite the horizontal belt section of the intermediate transfer belt for overlaying images of different colors to form an overlay image; and a transfer device for transferring the overlay image formed on the intermediate transfer belt onto a sheet;

wherein the belt unit is supported so as to be removable from the image forming apparatus in a direction perpendicular to shafts of the rollers and parallel to horizontal belt section.

2. The image forming apparatus according to claim 1, wherein the belt unit has belt cleaner in contact with the belt on the upstream side of the image forming unit on an extreme upstream side in belt travel direction, and the belt cleaner is integratedly formed with the belt unit so as to be removable together.

3. The image forming apparatus according to claim 1, wherein top of the image forming apparatus is provided with a discharge tray for ejecting sheets bearing a transferred overlay image, wherein the discharge tray is inclined upward in direction of the sheet ejection, and the intermediate transfer belt has an inclined belt section parallel to the discharge tray.

4. The image forming apparatus according to claim 1, wherein each image forming unit comprises an optical system unit for forming an electrostatic latent image on a photosensitive member, and a photosensitive member unit removable from the image forming apparatus and having at least the photosensitive member and a developing device for developing the electrostatic latent image formed on the photosensitive member, wherein the direction of removal of the belt unit is perpendicular to a removal direction of the photosensitive member unit.

5. The image forming apparatus according to claim 4, wherein the photosensitive member unit is removed toward a front side of the image forming apparatus.

6. The image forming apparatus according to claim 5, wherein the photosensitive member unit is provided with a cleaning device for cleaning the optical system unit when the photosensitive member unit is removed.

7. The image forming apparatus according to claim 5, further comprising a sensor which can be a registration sensor or toner density sensor provided medially to the transfer device and the photosensitive member unit on the uppermost upstream side in the direction of belt travel, and a cleaning unit, for cleaning the sensor when the photosensitive member unit is removed, is provided in the photosensitive member unit.

8. The image forming apparatus according to claim 5, wherein the photosensitive member unit is approximately square in shape when viewed from the direction of removal of the photosensitive member unit.

9. The image forming apparatus according to claim 1, wherein the transfer device is arranged opposite the roller through the belt near the image forming unit on the farthest downstream side in the direction of belt travel, and the belt unit is removable in a direction separating the belt unit from the transfer device.

10. The image forming apparatus according to claim 9, wherein the belt unit is removable in a retraction direction from both the transfer device and the image forming unit.

11. The image forming apparatus according to claim 1, further comprising a suction device for suctioning ozone generated by a discharger of each image forming unit below the image forming unit is provided below the image forming unit.

12. An image forming apparatus comprising:

a belt unit having a frame, at least three rollers supported by the frame, and an intermediate transfer belt supported on exterior surfaces of the three rollers, wherein the intermediate transfer belt includes a horizontal belt section;

a plurality of image forming units arranged opposite the horizontal belt section of the intermediate transfer belt for overlaying images of different colors to form an overlay image;

a transfer device for transferring the overlay image formed on the intermediate transfer belt onto a sheet; and a body frame for containing the belt unit and the image forming units and having a first frame in which an opening is formed to remove the belt unit in a first direction and a vertical frame in which an opening is formed to remove the image forming units in a direction.

13. The image forming apparatus according to claim 12, wherein the first vertical frame is arranged as a side frame and the second vertical frame is arranged as a front frame.

* * * * *